US005243960A

United States Patent [19]

Myles

[11] Patent Number: 5,243,960

[45] Date of Patent: Sep. 14, 1993

[54] APPARATUS FOR CUTTING STONE LAMINATE PANELS

[75] Inventor: Peter R. W. Myles, Highland Village, Tex.

[73] Assignee: Stone Panels, Inc., Carrollton, Tex.

[21] Appl. No.: 815,022

[22] Filed: Dec. 31, 1991

[51] Int. Cl.[5] ..... B28D 1/04

[52] U.S. Cl. ..... 125/21; 125/35

[58] Field of Search ..... 125/21, 12, 16.02, 35; 51/235, 283 R, 283 E

[56] References Cited

U.S. PATENT DOCUMENTS

| | | | |
|---|---|---|---|
| 1,043,433 | 11/1912 | Jackson | 125/21 |
| 3,723,233 | 3/1973 | Bourke | 161/68 |
| 3,950,202 | 4/1976 | Hodges | 156/154 |
| 3,963,846 | 6/1976 | Bourke et al. | 428/73 |
| 4,063,982 | 12/1977 | Bourke | 156/254 |
| 4,346,691 | 8/1982 | Bourke | 125/12 |
| 4,350,552 | 9/1982 | Bourke | 156/254 |
| 4,420,909 | 12/1983 | Steere, Jr. | 51/235 |
| 4,436,078 | 3/1984 | Bourke | 125/13 |
| 4,822,661 | 4/1989 | Battaglia | 428/116 |

FOREIGN PATENT DOCUMENTS

| | | | |
|---|---|---|---|
| 86200253.2 | 2/1986 | European Pat. Off. . | |
| 2154428 | 5/1973 | Fed. Rep. of Germany | 125/21 |
| 2734532 | 2/1978 | Fed. Rep. of Germany | 125/21 |

*Primary Examiner*—Robert A. Rose

*Attorney, Agent, or Firm*—Mason, Fenwick & Lawrence

[57] ABSTRACT

A power driven workpiece infeed conveyor supports a honeycomb-stone-honeycomb laminate on edge for feeding to an elevator conveyor in a work station. A fixed rear vertical panel of vacuum pads and a forward movable vertical panel of vacuum pads are separated by a space into which the workpiece is lifted by the elevator conveyor. The forward movable panel is moved rearwardly to cause the vacuum pad panels to engage front and rear surfaces of the workpiece and a source of vacuum is connected to the vacuum pads. The elevator conveyor is then lowered so that the workpiece is supported solely by the vacuum pads. A driven horizontal cutter wire flight then moves downwardly through the entire vertical dimension of the stone slab center portion of the workpiece to cut the workpiece into two stone-honeycomb panels. The elevator conveyor is then elevated, the vacuum pads vented to atmosphere, the front panel of vacuum pads moved forwardly to provide clearance, and the elevator conveyor and stone-honeycomb panels lowered to their original infeed position from which they are discharged to an outfeed conveyor.

8 Claims, 8 Drawing Sheets

APPARATUS FOR CUTTING STONE LAMINATE PANELS

BACKGROUND OF THE INVENTION

The subject present invention is in the field of architectural stone panel laminate construction and is even more specifically directed to apparatus and method for providing stone panel laminates consisting of a relatively thin slice of stone adhered to an aluminum honeycomb substrate of previously known type. Examples of such laminate construction are found in U.S. Pat. Nos. 3,723,233, 3,950,202, 3,963,846, 4,063,982 and 4,822,661.

It has been conventional practice to form stone-honeycomb laminates by first providing a workpiece consisting of a honeycomb-stone-honeycomb laminate in which a stone slab is positioned between two honeycomb substrates adhered to opposite outer sides of the stone slab. Such workpieces are then separated into a pair of stone-honeycomb laminate structures by cutting through the original stone slab from one edge midway between the opposite outer surfaces thereof to which the honeycomb structures are adhered. Such cutting operation has been previously effected in a variety of ways including the use of a circular saw having a large circular blade mounted on a carriage which reciprocates back and forth across the slab while the saw carriage support moves toward the slab; other circular saws simply make a single pass through the slab. Thus, the circular saw cuts downwardly through the middle of the stone slab of the honeycomb-stone-honeycomb workpiece sandwich laminate. Some circular saws have been used in conjunction with suction pads provided on opposite sides of a honeycomb-stone-honeycomb laminate resting on its lower edge surface for holding the laminate in a transversely stable position such as in U.S. Pat. Nos. 4,063,982, 4,346,691, 4,436,078 and 4,360,562. However, circular saw devices of the foregoing type are limited in the size of slab through which they can cut in a single pass since the maximum size is obviously less than the radius of the circular saw blade. Consequently, when larger laminates are being used, it has been the practice, such as in European Patent Application 86200253.2, to cut a first kerf downwardly from the upper edge of the workpiece as far as the dimensions of the circular saw will permit. The circular saw is then raised above or otherwise removed from the workpiece and the workpiece is rotated 180 degrees to present its previously lower surface in the upward position facing the circular saw which is then reactivated and cuts downwardly to form a second kerf which will merge with the first kerf. The foregoing procedure is time-consuming and does not always result in satisfactory results since the second kerf does not always precisely line up with the first kerf.

Other stone cutter devices have employed closed-loop diamond impregnated band saws as in U.S. Pat. No. 4,063,982 or wire cutters mounted on a pair of spaced pulleys for cutting stone members and the like as the wire is continuously moved in a closed loop and progressed forwardly through the stone being cut in a direction perpendicular to the flight of the wire effecting the cut. However, devices of this type have not been considered to be suitable for forming stone-honeycomb laminae due to the fact that the cutter flight of the wire cutter is relatively long and would not be operable with the workpiece handling equipment of the type employed in the above-discussed circular saw apparatus.

Prior to the present invention, the largest honeycomb-stone-honeycomb sandwich laminate workpiece that could be cut to provide two stone-honeycomb panels of the same length and width as the workpiece was nine feet six inches long and 60 inches wide. Thus, the size of the final work product was limited. Since architectural laminate stone panels are used for wall coverings in office buildings and the like, aesthetic enhancement and substantial savings in labor and other mounting expense could be achieved by the use of larger panels. Therefore, there has been a demand for larger panels which, prior to the present invention, had not been met by the prior art apparatus and methods.

Therefore, it is the main object of the present invention to provide a new and improved apparatus and method for cutting honeycomb-stone-honeycomb sandwich laminae into two stone-honeycomb laminae finished products.

A further object of the present invention is the provision of an improved method and apparatus for providing stone-honeycomb laminae by a single uninterrupted cutting operation without any intermediate workpiece manipulation being required.

SUMMARY OF THE INVENTION

The preferred embodiment of the present invention consists of a closed loop wire cutter apparatus provided in conjunction with unique workpiece handling means for manipulating and supporting conventional workpieces of the honeycomb-stone-honeycomb type of a relatively large size so that they can be cut in a single uninterrupted operation.

More specifically, workpiece handling apparatus includes a power driven infeed conveyor in which driven feed rollers support a vertically oriented three part laminate workpiece of the honeycomb-stone-honeycomb .type and feed the workpiece on to a vertically movable elevator in a work station The elevator is positioned below the lower horizontal cutter flight of the closed loop stone cutter machine wire cutter and includes an elevator frame on which a plurality of power driven elevator conveyor rollers are provided for engaging the lower edge of a workpiece fed on to the elevator conveyor rollers by the operation of the infeed conveyor. The workpiece supported on the elevator conveyor rollers is oriented in a substantially vertical plane.

A pneumatic cylinder powered scissors-type arrangement is activated to cause the elevator frame to be moved vertically upward to lift the workpiece to a position in which its upper surface faces a horizontal cutter wire flight of the closed loop cutter device. When the workpiece reaches its elevated position, the workpiece is positioned between a movable vacuum pad carriage on which a plurality rearwardly facing vacuum suction pads are provided in a common vertical plane and a fixedly positioned rearward vacuum suction pad frame supporting a plurality of forwardly facing suction pads. The movable vacuum pad carriage is then moved rearwardly on supporting track means so that the rearwardly facing suction pads engage the front face of the workpiece and move the workpiece a small distance rearwardly until its rear surface engages the forwardly facing vacuum pads on the fixedly positioned rearward frame. A vacuum source is then connected to both the rearwardly facing and the forwardly facing suction pads so that both the forwardly facing and rearwardly facing suction pads are immediately secured in high friction contact with the front and rear surfaces of the workpiece. The elevator is then lowered; however, the workpiece is fixedly maintained in its elevated position with its upper edge below and facing the horizontal cutter wire flight of the stone cutter machine by the operation of the vacuum suction pads.

The diamond dust saw wire is activated to axially move the horizontal cutter wire flight at a desired velocity while it is slowly lowered downwardly until it contacts and begins to cut the upper surface of the stone panel component with continued downward movement of the lower flight of the cutter wire effecting the formation of a kerf from top to bottom all the wa through the stone component. Forward and rearward stone-honeycomb-laminae panels are therefore formed when the cutter flight completes its passage from the upper surface to the lower surface through the entire height of the central stone slab component of the honeycomb-stone-honeycomb workpiece. The forward laminate panel is supported by the rearwardly facing suction pads while the rearward laminate panel is supported by the forwardly facing suction pads.

The elevator is then raised to engage the lower edge surfaces of the two stone-honeycomb laminae panel and the vacuum terminated and the vacuum pads vented to atmosphere so that the vacuum pads release the forward and rearward stone-honeycomb laminae which then rest on the elevator conveyor rollers. The elevator frame is then lowered to its original starting position in which the conveyor rollers on the elevator frame are aligned with the outfeed rollers of an outfeed conveyor. The conveyor rollers on both the elevator frame and the outfeed conveyor are then simultaneously activated to remove the two finished work product stone-honeycomb laminae panels from the machine.

BRIEF DESCRIPTION OF THE DRAWINGS

FIG. 15(*a*) is a side elevation similar to FIG. 15 but illustrating the position of the finished stone-honeycomb panels following completion of the cutting operation;

DESCRIPTION OF THE PREFERRED EMBODIMENT

Figure 1:
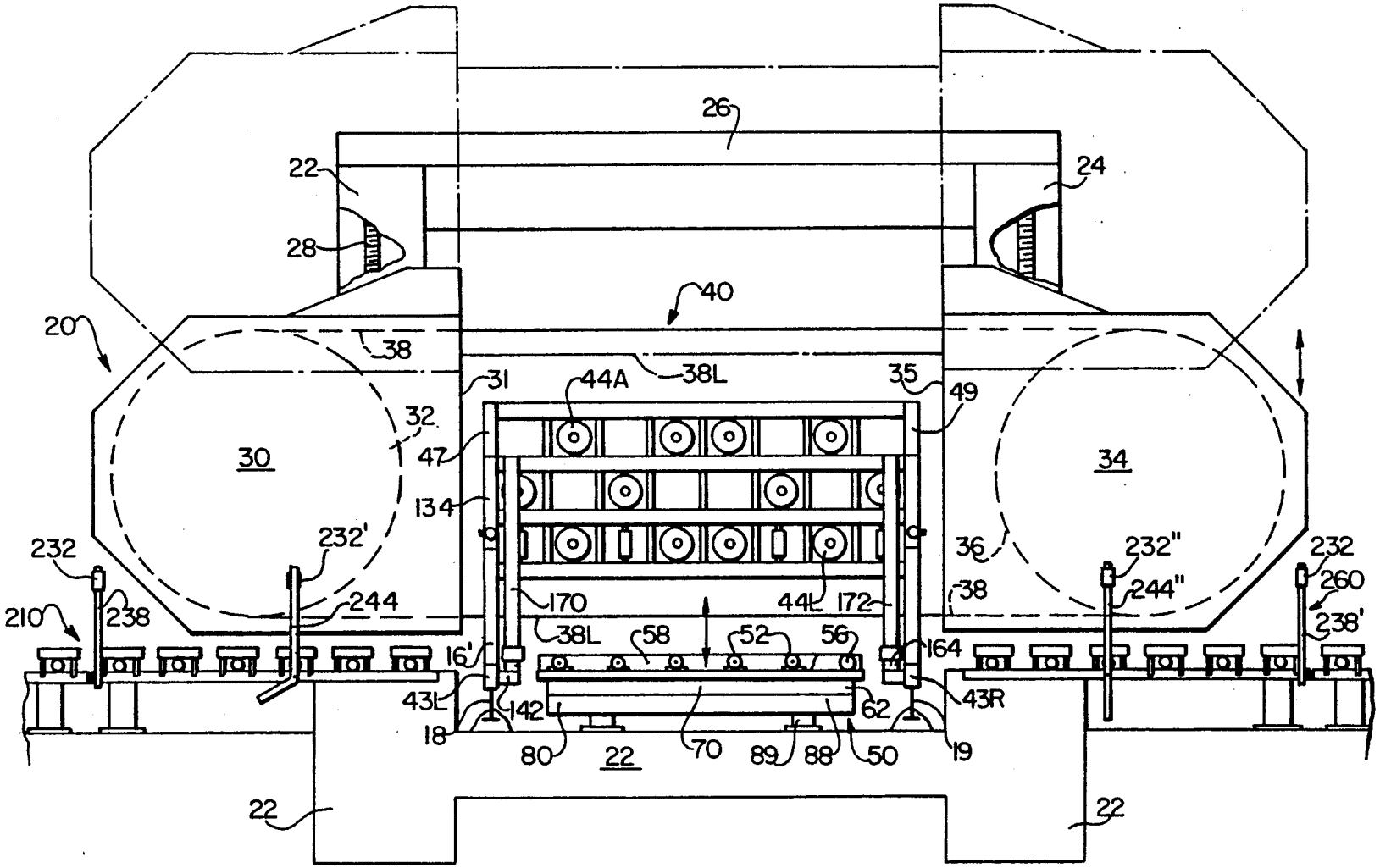
FIG. 1 is a front elevation of the preferred embodiment of the apparatus for practice of the invention.

Attention is initially invited to FIG. 1 of the drawings which comprises a front elevation view of the preferred embodiment 20 for practice of the invention. A main concrete support footing 22 supports the working apparatus which includes a diamond impregnated closed loop wire saw stone cutter comprising a modified Model DF 2000 stone saw or cutter manufactured by Pelligrini Meccanica SPA of Verona, Italy. The stone cutter includes a left cutter unit support column 22 and a right cutter unit support column 24 which are connected by a bridge or cap frame 26. A vertical threaded lift/lower elevator screw 28 is provided in each of the columns 22 and 24 for permitting vertical movement of the closed loop cutter wire 38 and its associated supporting and driving apparatus between a lower solid line position and an upper-dashed line position as shown in FIG. 1.

Figure 2:
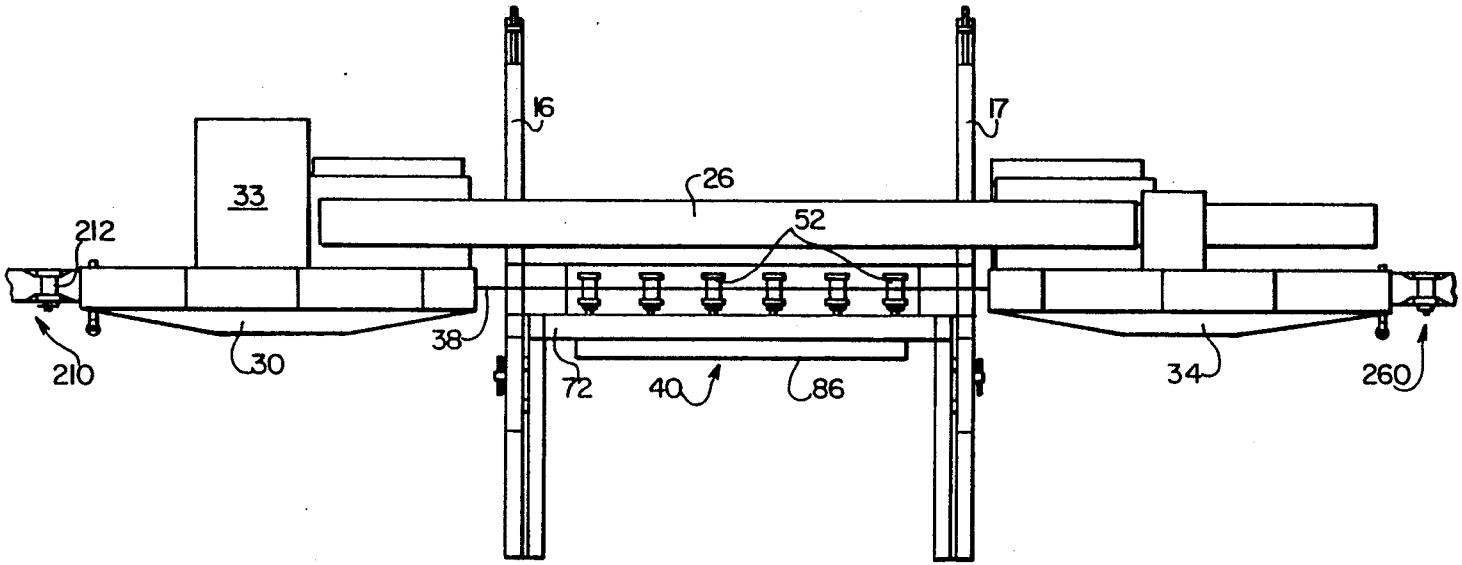
FIG. 2 is a top plan view of the preferred embodiment.

The vertically movable cutter wire support and drive assembly includes a left flywheel housing 30 in which a left flywheel pulley 32 driven by a motor 33 (FIG. 2) is mounted fot rotation and a right flywheel housing 34 in which a right flywheel pulley 36 is mounted for rotation. The closed loop cutter wire 38 is of circular cross section and extends over the left flywheel pulley 32 and the right flywheel pulley 36 for travel in a continuous loop including a horizontal lower cutter flight 38L in a well-known manner. The cutter wire is impregnated with diamond dust or the like particles and is capable of cutting through the hardest of stone.

The aforementioned construction of the stone cutter is the same as a conventional Model DF 2000 cutter of the type frequently used to provide large rough-cut slab of quarry blocks of stone with the exception of the fact that the distance between the vertical columns 22 and 24 and the flywheel pulleys 32 and 36 and their axes of rotation is reduced so that the length of the lower flight 38 L is approximately 5.15 meters, i.e. one meter less than the 6.15 meters dimension of the conventional DF 2000 machine as measured with a cold cutter wire, the dimension increasing somewhat as the cutter wire heats up and elongates during operation. This reduction in dimension is achieved by reducing the distance between the axes of rotation of the wire supporting pulleys in housings 30 and 34 of the DF 2000 machine by one meter.

Figure 7:
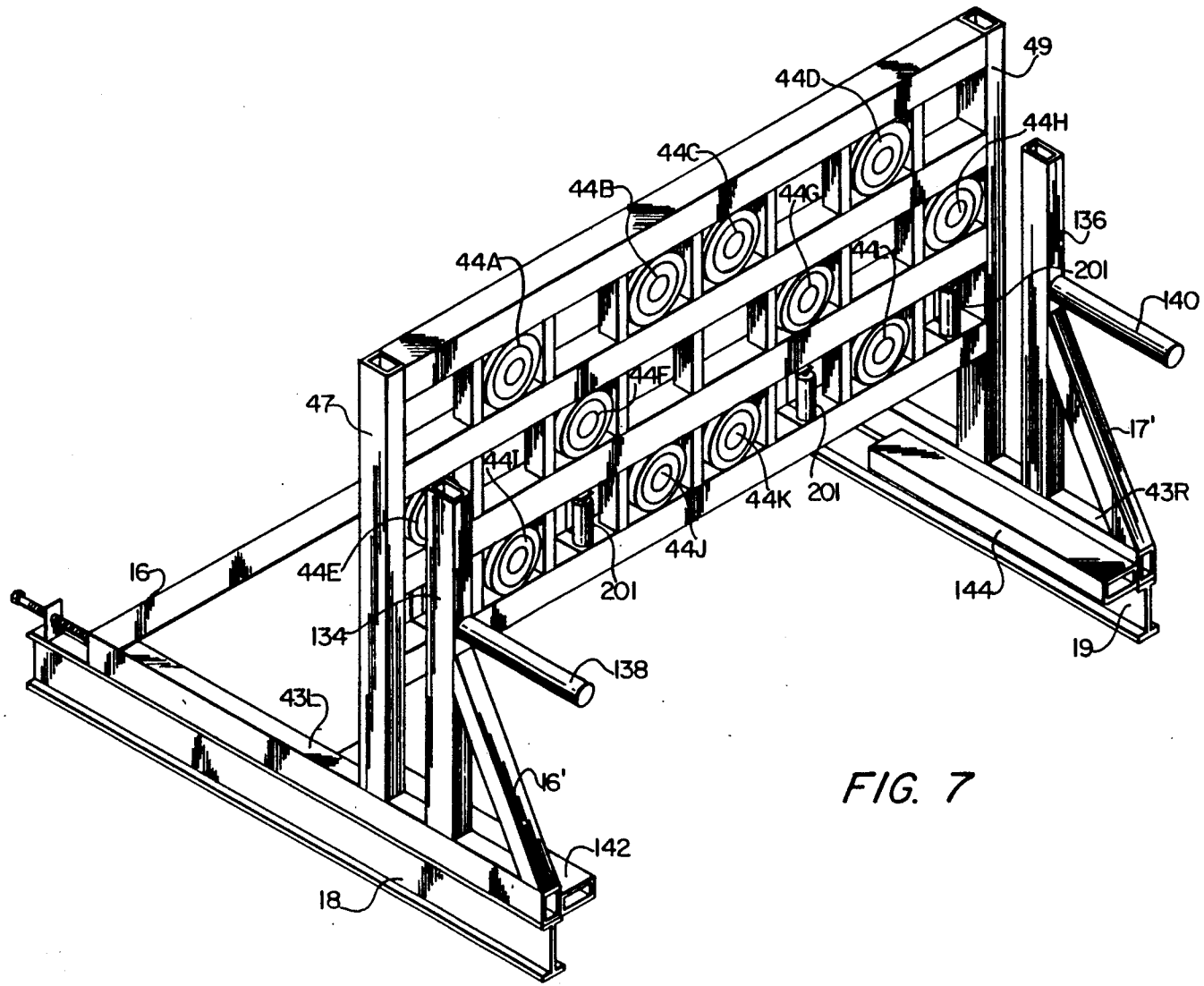
FIG. 7 is a front perspective view of a rearwardly positioned fixed vacuum pad assembly.

A work station 40 is centrally provided in the space between the left flywheel housing 30 and the right flywheel housing 34 which respectively have inwardly facing vertical edge surfaces 31 and 35 facing the work station. The major components of the work station 40 include a rearwardly positioned fixed vacuum pad support assembly generally designated 42 which is best illustrated in FIG. 7 and which includes a plurality of forwardly facing conventional vacuum pads 44A, 44B, 44C, 44D, 44E, 44F, 44G, 44H, 44I, 44J, 44K and 44L all of which are mounted to form a panel in a common vertical plane on the rear side of the lower flight 38L of the cutter wire 38.

Figure 8:
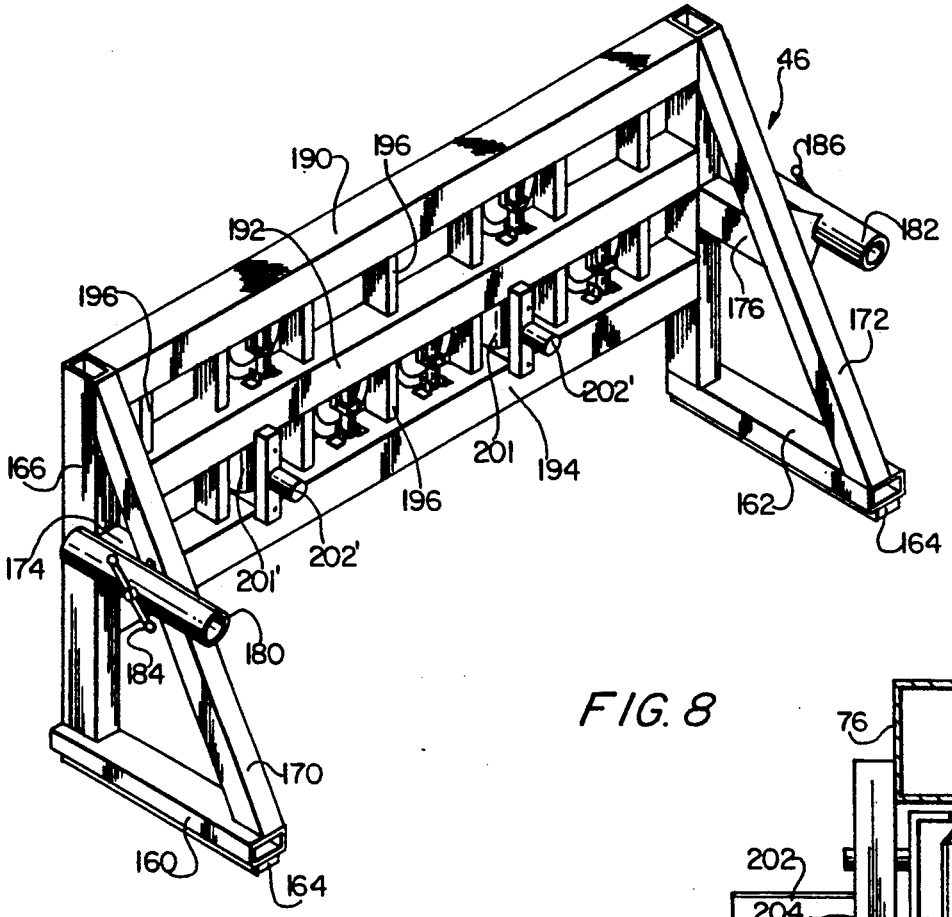
FIG. 8 is a front perspective view of a forwardly positioned movable rearwardly facing vacuum pad supporting carriage assembly.
Figure 10:
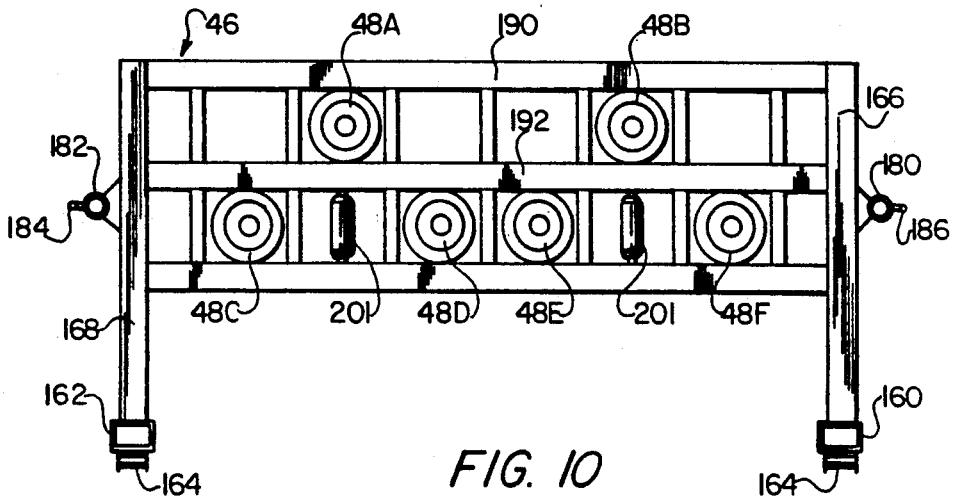
FIG. 10 is a rear elevation view of the forwardly positioned movable rearwardly facing vacuum pad supporting carriage assembly of FIG. 8.

Similarly, a second major component of work station 40 is a forwardly positioned movable vacuum pad carriage assembly 46 which is best shown in FIGS. 8 and 10 and which includes a plurality of rearwardly facing conventional circular vacuum pads 48A, 48B, 48C, 48D, 48E and 48F as best shown in FIG. 10. The rearwardly facing vacuum pads 48A, etc. are all provided in a panel oriented in a common vertical plane spaced forwardly of the lower flight 38F of the cutter wire. Additionally, the vacuum pads 48A, etc. and 44A, etc are of identical conventional construction and are preferably Model No. 40732 vacuum pads sold by Strato-Vac, Inc. of Chicago, Ill. It should be noted that none of the forwardly facing vacuum pads 44 are aligned with any of the rearwardly facing vacuum pads 48.

Figure 4:
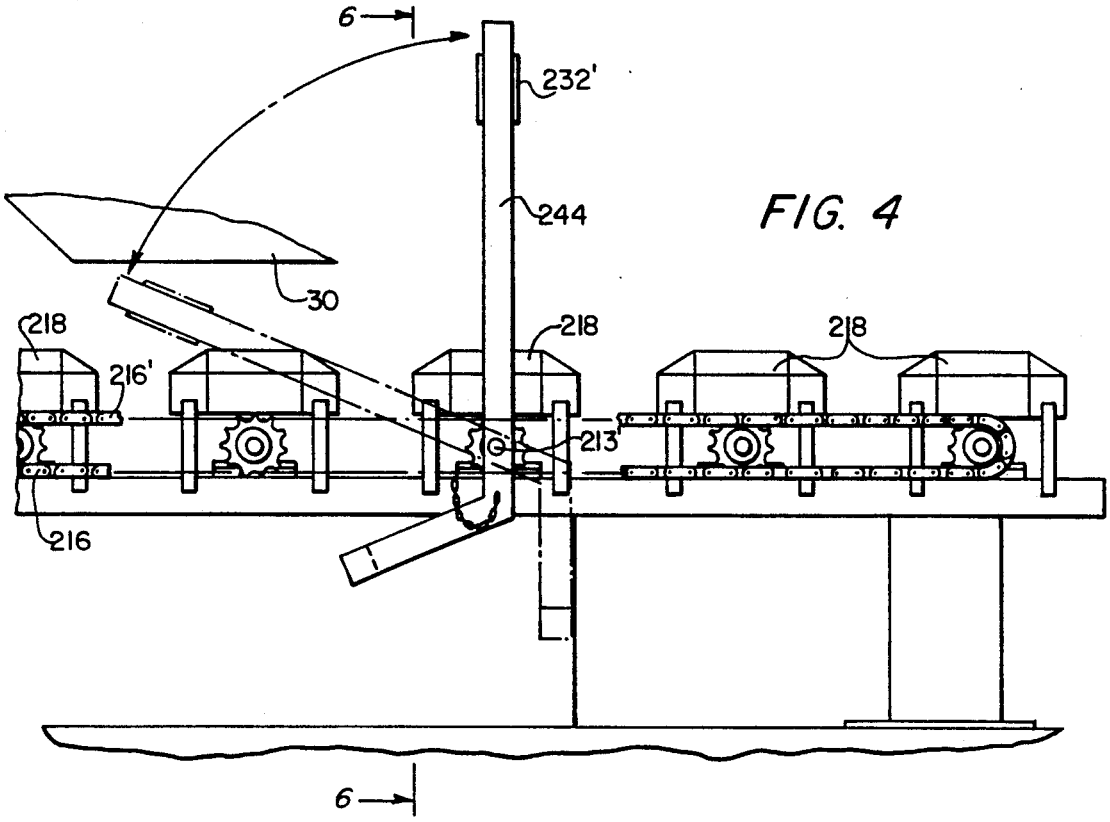
FIG. 4 is a front elevation view of a portion of the infeed conveyor means.

A third major component of the work station comprises an elevator conveyor apparatus 50 positioned at a lower level in general vertical alignment with the lower flight 38L of cutter wire 58 and positioned beneath the vacuum pads 44 and 46. The elevator conveyor apparatus 50 includes a plurality of conveyor rollers 52 each driven by chain means 54 which is driven by a selectively operable motor 56 (FIG. 4). Rollers 52 are mounted on parallel shafts 53 which are supported between a rear support plate 58 and front support plate 60. The plates 58 and 60 are part of a rectangular elevator frame generally designated 62 which includes front to rear extending left and right end frame channels 64 and 66 which are connected between a rear frame 68 (FIG. 11) and a front frame 70 (FIG. 1).

Figure 11:
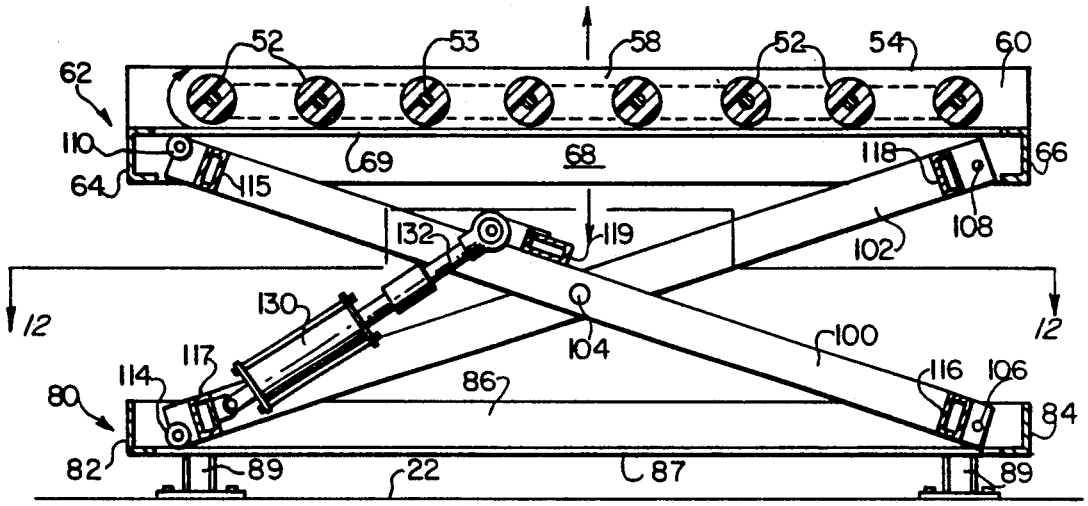
FIG. 11 is a front longitudinal sectional elevation of a work support elevator employed in the work station.
Figure 12:
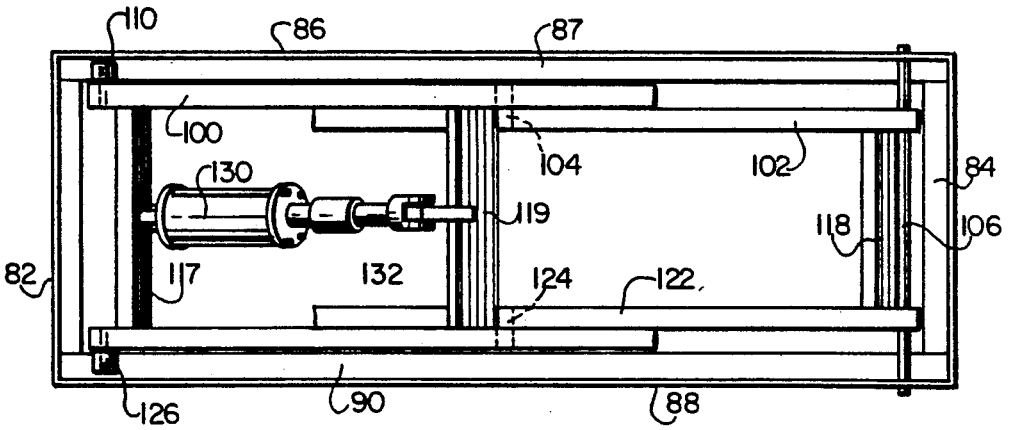
FIG. 12 is a sectional view taken along line 12—12 of FIG. 11.

Support for the foregoing elevator frame components is provided by a rectangular base frame 80 formed of left and right frame components 82 and 84, a rear lengthwise extending frame component 86 (FIG. 11) and a forward lengthwise extending frame component 88 (FIG. 12). Base frame 80 is supported on the main concrete support footing 22 by means of pedestal members 89.

Rectangular elevator frame 62 is connected to base frame 80 for vertical movement by a scissor arrangement illustrated in FIG. 11 and 12 and comprising a pair of rear pivot arms 100, 102 which are connected near their midpoints by a pivot shaft 104. The first rear pivot arm 100 is pivotally mounted at a its lower end to the rectangular base frame 80 by fixed lower pivot shaft 106 while the upper end of the other rear pivot arm 102 is pivotally connected to the rectangular elevator frame 62 by upper pivot shaft 108. A traveling roller 110 is mounted on the upper end of the rear pivot arm 100 and engages the lower surface of horizontal flange 69 of the rear frame 68. Similarly, the lower end of the other rear pivot arm 102 has a travelling roller 114 mounted thereon with the roller 114 resting on the upper surface of flange 87 of the rear lengthwise extending frame component 86 of the rectangular base frame 80 as best shown in FIG. 11. Front to rear extending connector box frames 115 and 116 are each welded at their rear extent to the first rear pivot arm 100. Similarly, connector box frames 117 and 118 are welded at their rear extent to the other rear pivot arm 102.

First and second front pivot arms 120 and 122 are respectively parallel to the rear pivot arms 100 and 102 and are pivotally connected together near their midpoints by pivot means 124 as best shown in FIG. 12. The forward ends of the front to rear extending box frames 115 and 116 are welded to front pivot arm 120. Similarly, the forward ends of the front to rear extending box frames 117 and 118 are welded or otherwise connected to front pivot arm 122. A travelling roller 126 is mounted on the lower end of front pivot arm 120 and rides on horizontal flange 90 of the front lengthwise extending frame component 88 of the rectangular base frame 80. The upper end of front pivot arm 120 is pivotally connected to upper pivot shaft 108. Similarly, the lower end of front pivot arm 122 is pivotally mounted on lower pivot shaft 106 whereas its upper end has a roller (not shown) engageable with the lower surface of a flange provided on the front frame component 70 in a manner analogous to the engagement of travelling roller 110 in flange 69 of the rear frame component 68.

Figure 13:
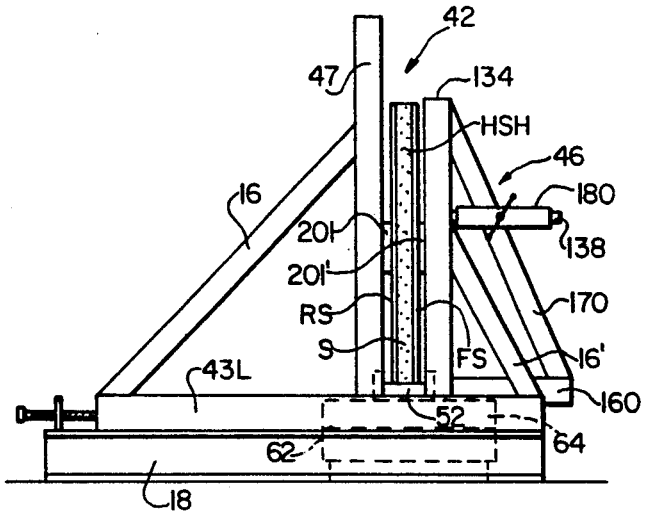
FIG. 13 is a left side elevation of the work station illustrating the work support elevator in its lower position and the front suction pad carriage assembly in its forward position assumed for permitting the infeed or outfeed of a stone-honeycomb laminate workpiece.
Figure 15A:
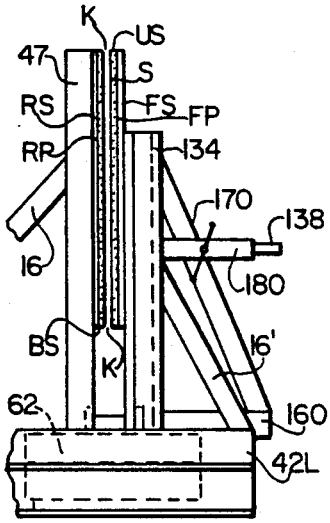
FIG. 15 is a end elevation similar to FIG. 14 but illustrating the front vacuum pad carriage assembly in its rearward position in which it cooperates with the rear vacuum pad assembly to support the stone-double honeycomb sandwich laminate workpiece preparatory to the initiation of a cutting operation.
Figure 14:
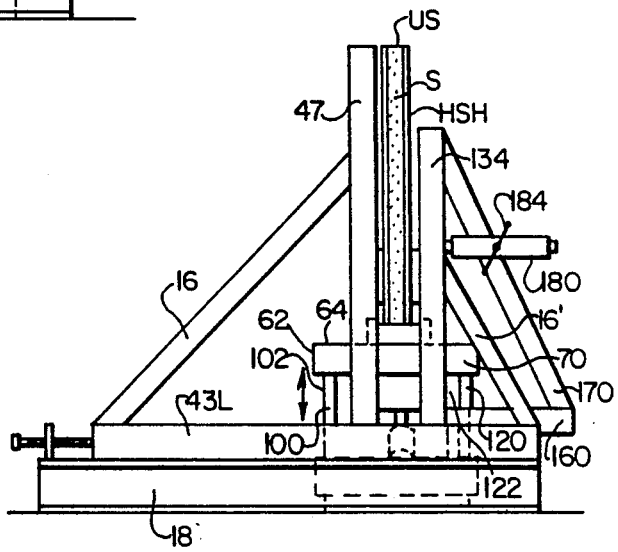
FIG. 14 is an end elevation similar to FIG. 13 but illustrating the work support elevator in its uppermost position.

A pneumatic piston and cylinder assembly 130 has its cylinder connected to the front to rear extending box frame 117 and has its rod 132 connected to the front to a front to rear extending box drive frame 119 which is welded to pivot arms 100 and 122 as shown in FIGS. 11 and 14. Extension of the pneumatic piston and cylinder assembly 130 to the position illustrated in FIG. 11 causes the elevator frame 62 to be lifted to its elevated position shown in FIG. 11. On the other hand, contraction of the piston and cylinder assembly 130 causes the elevator frame 62 to be lowered to its lower position illustrated in FIGS. 1 and 13.

Support for the rearwardly positioned fixed vacuum pad support assembly 42 is provided by left and right I beams 18 and 19 (FIGS. 1 and 7) the upper flanges of which respectively support a left base beam 43L and 43R of the rearwardly positioned fixed vacuum pad support assembly 42. A rear left vertical column 47 extends upwardly from base beam 43L and a rear right vertical column 49 extends upwardly from the base beam 43R. Similarly, a left hand forward vertical column 134 also extends upwardly from the base beam 34L and a similar right hand forward vertical column 136 extends upwardly from the right hand base beam 43R. Rigid horizontal guide pipes 138 and 140 extend forwardly from the vertical columns 134 and 136 as shown in FIG. 7. A left hand base beam track 142 is welded to the inner side of a left hand base beam 43L and a similar right hand base beam track 144 is welded to the inner surface of the right hand base beam 43R. The rigidity is imparted to the vertical columns 47 and 49 by rearward diagonal brace members 16 and 17. Similarly, forward diagonal brace members 16' and 17' provide rigidity for the vertical columns 134 and 136. The vertical columns 47 and 49 are welded to an upper horizontal box beam 72, a lower horizontal box beam 73 and two intermediate box beams 75 and 76 as shown in FIG. 7.

Figure 9:
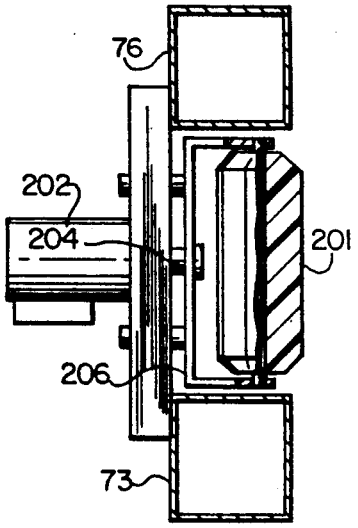
FIG. 9 is a side elevation partially in section illustrating infeed/outfeed guide rollers employed for guiding honeycomb-stone-honeycomb laminate sheets into the work station and for guiding stone-honeycomb finished product laminae from the work station.

Three workpiece guide rollers 201 are provided between the box beams 73 and 76 as best shown in FIG. 7. Each workpiece guide roller 201 is mounted for reciprocal movement perpendicular to its axis in a front to rear direction by means of a pneumatic piston and cylinder assembly 202 (FIG. 9) having a piston rod 204 connected to a bracket 206 on which the roller is mounted. The rollers 201 are tapered at each end and are formed of plastic material mounted on a shaft 208 supported on bracket 206. When the pneumatic piston and cylinder assembly 202 is activated to extend the piston rod 204, the roller is moved forwardly so that it extends forwardly of the front surface of members 73, 76, etc. and can act to guide a honeycomb-stone-honeycomb workpiece into or from the work station.

The forwardly positioned movable vacuum pad support carriage assembly 46 is supported on base beam tracks 142 and 144 and includes a left hand base beam 160 (FIG. 8) and a right hand base beam 162 with a plurality of support roller 164 being attached to and extending beneath the base beams 160 and 162 as best shown in FIG. 10. The rollers 164 rest on the upper surface of the left hand base beam track 142 and the right hand base beam track 144 of the rearwardly positioned fixed vacuum pad support assembly 42; carriage assembly 46 can consequently be moved either toward or away from the rearwardly positioned fixed vacuum pad support assembly 42.

A left hand vertical column 166 extends upwardly from the rearmost end of left hand base beam 160 and a similar right hand vertical column 168 extends upwardly from the rear extent of the right hand base beam 162. Vertical columns 166 and 168 are respectively braced by diagonal brace members 170 and 172. Additionally, intermediate horizontal brace members 174 and 176 respectively extend between the left hand vertical column 166 and diagonal brace 170 and the right hand vertical column 168 and the diagonal brace 172.

A left guide tube 180 is attached to diagonal brace 170 and a right guide tube 182 is similarly attached to the right hand diagonal brace 172. The guide tubes 180 and 182 are coaxially aligned with the rigid horizonal guide pipes 138 and 140 of the rearwardly positioned vacuum pad support assembly 42 and matingly fit over the guide pipes 138 and 140. Clamp actuator rods 184 and 186 are mounted on threaded rods threadably mounted in the guide tubes 180 and 182 so that clamping members on the inside of tubes 180 and 182 (not shown) are engageable with the outer surface of the rigid horizontal guide pipes 138 and 140 so that the forwardly positioned movable vacuum pad carriage assembly 46 can be selectively locked in any desired fixed position relative to the rearwardly positioned fixed vacuum pad support assembly 42. However the clamp means can be released so as to permit the forwardly positioned movable vacuum pad carriage assembly be moved forwardly or rearwardly toward or away from the rearwardly position assembly 42. The vertical columns 166 and 168 are weldingly connected to an upper horizontal box beam 190, an intermediate horizontal box beam 192 and a lower horizontal box beam 194. Additionally, adjacent ones of the box beams 190, 192 and 194 are interconnected by vertical spacers 196.

First and second selectively positionable workpiece guide rollers 201 which are identical to rollers 201 are provided between the intermediate horizontal box beam 192 and a lower horizontal base beam 194 as best shown in FIG. 10. Each workpiece guide roller 201' is mounted for reciprocal movement perpendicular to its axis in a front to rear direction by means of a pneumatic piston and cylinder assembly 202' identical to the piston and cylinder assemblies 202. When the pneumatic piston and cylinder assembly 202' is activated to extend its piston rod, its associated guide roller 202' is moved rearwardly so that it extends beyond the rear surface of members 190, 166, etc. and can act to guide a workpiece HSH into or from the work station.

The remaining components of the preferred embodiment include an infeed conveyor 210 for feeding conventional three-part honeycomb-stone-honeycomb sandwich laminate workpieces HSH to the work station 40 and an outfeed conveyor means 260 for discharging the finished products comprising two-piece stone-honeycomb laminate SH structures from the work station 40.

Figure 3:
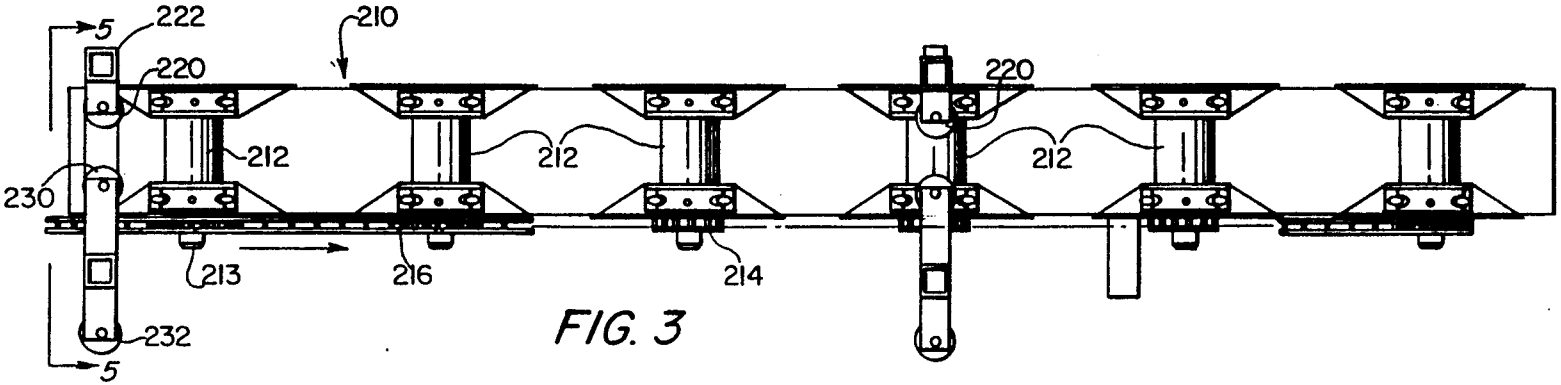
FIG. 3 is a top plan view of a portion of infeed conveyor means employed in the preferred embodiment.

Infeed conveyor 210 (FIG. 3) feeds the three-part workpieces HSH to the work station 40 by means of a plurality of driven infeed rollers 212 on which the lower edge of the workpiece rests in a vertical plane for movement into the work station 40. The number of rollers depends upon the particular layout of the facility and the rollers are driven by sprockets 212 by a drive chain 216. The drive chain 216 is driven by a conventional electric motor (not shown) and each roller is of solid plastic material mounted on a shaft 213. Metal guards 218 are provided over each end of each of the driven infeed rollers to aid in feeding the workpiece along the conveyor.

Rear infeed guide rollers 220 (FIG. 5) ar mounted the top of fixed rear supports 222 so as to engage the upper portion of the rear surface RS of the workpiece HSH as it moves along the conveyor. Forwardly positioned selective upper guide rollers 230 and 232 are selectively positionable to engage the front surface FS of the workpiece HSH as it is fed along the conveyor. It will be noticed that the selective upper guide rollers 230 and 232 are supported on a selectively positionable cap column 234 having a lower male coupling member 236 of reduced size matingly received in the female upper end of fixed forward column 238. The guide roller 230 is spaced from the selectively positionable cap column 234 a greater distance than is the roller 232. With the parts in the position shown in FIG. 5 the roller 230 is positioned to engage a workpiece of minimum thickness; however the cap column 234 can be lifted upwardly from engagement with the fixed front support column and rotated 180 degrees to reverse the position of rollers 230 and 232 so that the roller 232 can be used for aiding in the infeed of the workpiece of greater thickness than the thickness of a workpiece HSH shown in FIG. 5.

Figure 6:
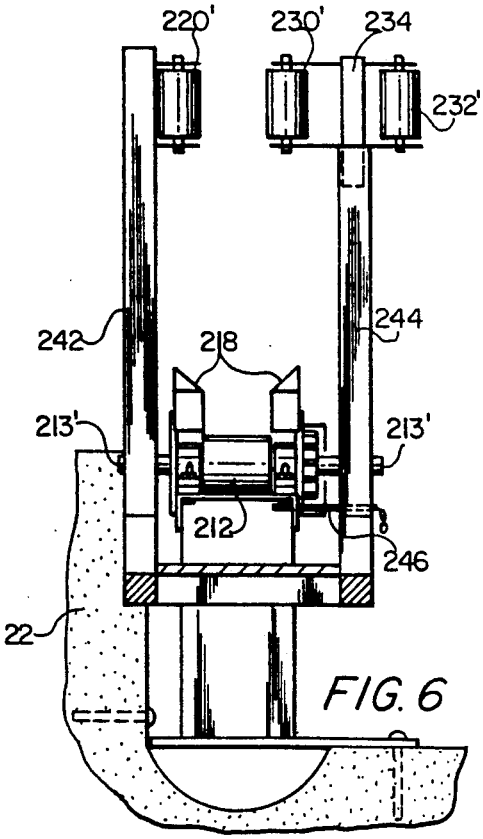
FIG. 6 is a sectional view taken along lines 6—6 of FIG. 4.

The guide rollers 220', 230' and 232' are positioned on pivotal rear and front swing column members 242 and 244 which are mounted for pivotal movement on extended shaft means 213'. The pivotal columns 242 and 244 are capable of movement between the vertical solid-line position and the lower dashed-line position illustrated in FIG. 4. The columns are maintained in their vertical position by latch pins such as pin 246 extending through the lower end of column 244 into the frame of the conveyor as best shown in FIG. 6. The columns 242 and 244 are maintained in their vertical position during the infeed of a workpiece by the infeed conveyor with it being noted that the saw assembly is in the elevated dashed line position of FIG. 1 during the time the workpiece HSH is being fed into the work station 40. However, after the workpiece is fed into the work station, the roller supporting columns 242 and 244 are pivoted to their lower dashed line position to provide sufficient clearance to permit the left flywheel housing 3 to be moved to its lower solid line position of FIG. 1 without engaging the roller support columns or the rollers as would occur if they had remained in their upper solid lined position.

Outfeed conveyor 260 is essentially identical to the infeed conveyor 210 and includes a pivotal front column 244'' (FIG. 1) operable in the manner of column 244 and fixedly positioned front columns 238' supporting guide rollers 232'' as shown in FIG. 1. Thus, the pivotal front column 244'' can pivot downwardly in the same manner as the column 244 to permit the right flywheel housing 34 to be lowered to its foremost solid line position of FIG. 1.

Figure 5:
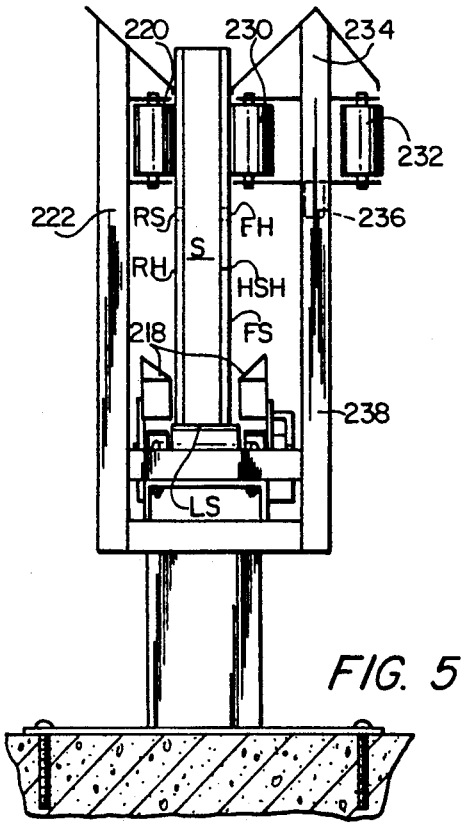
FIG. 5 is a sectional view taken along lines 5—5 of FIG. 3.

A cycle of operation will now be described with the initial reference being made to FIG. 5 in which a workpiece HSH comprising a sandwich laminate consisting of a rear honeycomb layer RH, a stone slab or layer S and a front honeycomb layer FH of rectangular configuration including a planar lower surface LS, a rear surface RS and front surface FS is fed to the work station by the infeed conveyor 210. The front and rear surface FS and RS are preferably provided by a thin film or resin sheet or other plastic of air impervious nature for permitting the vacuum pads to be effective.

During the initial infeed step of operation the elevator frame 62 is in the lower position illustrated in FIGS. 1 and 13 so that the elevator rollers 52 are in horizontal alignment with the infeed rollers 212 of the infeed conveyor. It should also be noted that during the initial infeeding of the workpiece to the work station 40 the forwardly positioned movable vacuum pad support carriage assembly 46 is in its forward position as shown in FIG. 13. Moreover, the selectively operable guide rollers 201 on the rearwardly positioned fixed vacuum pad support assembly 42 are in their forwardly extending position to permit the rollers 201 to engage the rear surface RS of workpiece HSH while the selectively positionable workpiece guide rollers 201' mounted on the forwardly positioned movable vacuum pad support carriage assembly 46 are in their rearwardly extended position to engage the front surface FS of the workpiece as shown in FIG. 13.

Figure 16:
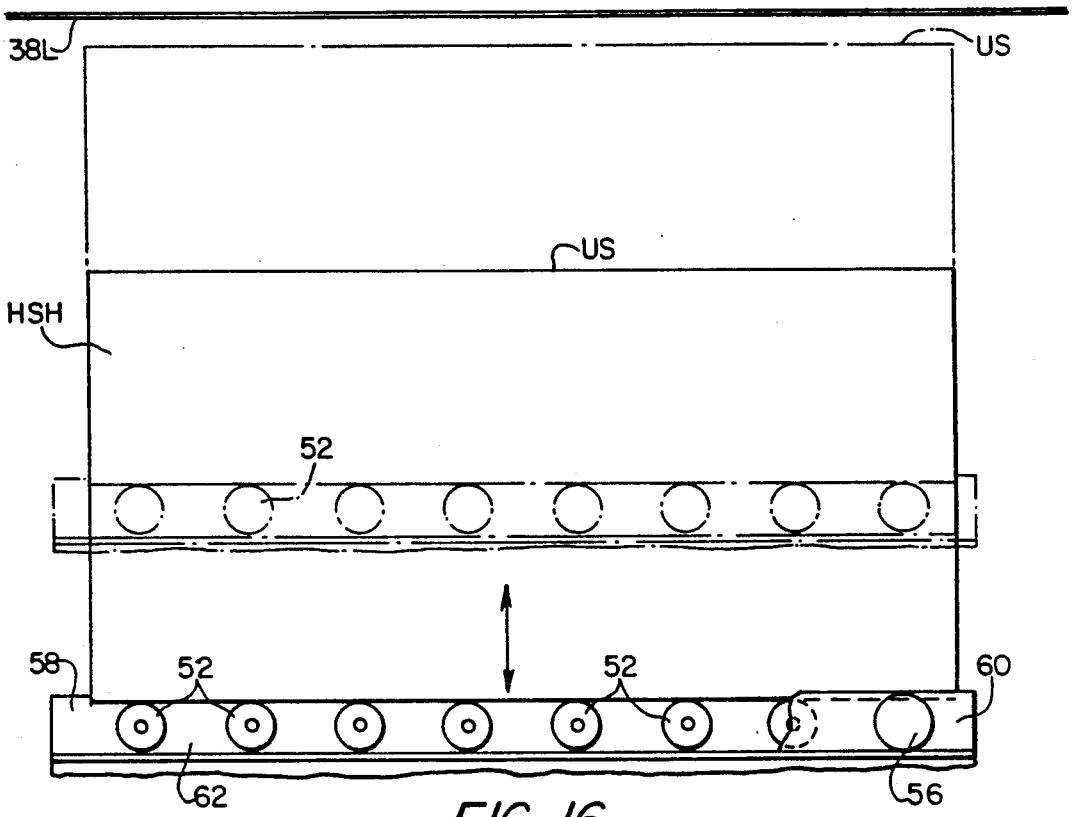
FIG. 16 is a front elevation view illustrating in solid lines the work support elevator in its lower position corresponding to that of FIG. 13 and in dashed lines corresponding to the elevated position of FIGS. 14 and 15.
Figure 17:
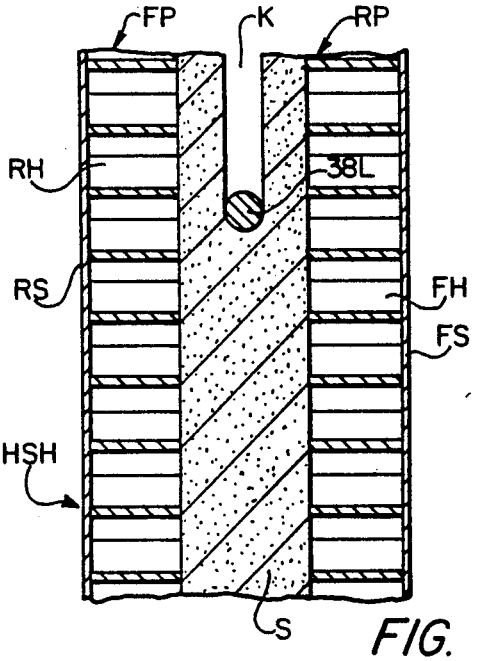
FIG. 17 is a bisecting sectional view through the honeycomb-stone-honeycomb workpiece laminate illustrating the manner in which it is cut to provide a pair of stone-honeycomb laminates comprising the finished product provided by the inventive method and apparatus.
Figure 18:
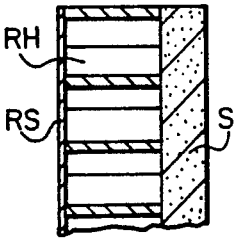
FIG. 18 is an enlarged sectional view through a finished product honeycomb-stone-laminate resultant from the procedure illustrated in FIG. 17.

Forward feeding movement of the elevator conveyor rollers 52 is terminated so as to stop the workpiece HSH in the solid dashed line position of FIG. 16 and similarly in FIG. 13. Rollers 201 and 201' are then retracted so that they no longer engage the rear surface RS and the front surface FS of the workpiece HSH.

Pneumatic cylinder 130 is then extended so as to cause the rectangular elevator frame 62 to move upwardly to its elevated position as illustrated in FIGS. 11 and 14 and as illustrated in dashed lines in FIG. 16. The workpiece HSH is also obviously moved to the dashed line position of FIG. 16 so that its planar upper surface US is below the wire cutter flight 38L as shown in FIG. 16. Thus, the workpiece HSH is in its elevated position but is still supported by the elevator rollers 52.

The next step in the procedure is rotation of the clamp actuator rods 184 and 186 to release the clamping means operable on the guide pipes 138 and 140 to permit the forwardly positioned movable vacuum pad support carriage assembly 46 to be bodily rolled rearwardly on rollers 164 so that the rearwardly facing circular vacuum pads 48 etc. engage the front surface FS of the workpiece HSH and move the workpiece a small distance rearwardly until the rear surface RS engages the forwardly facing vacuum pads 44 etc. of the rearwardly positioned fixed vacuum pads support assembly 42. At approximately the same time, vacuum is supplied to both the rearwardly facing circular vacuum pads 48 and the forwardly facing vacuum pads 44 etc. so that the vacuum pads are snugly engaged with the forward and rear air impervious sheet surfaces FS and RS of the workpiece. Since the vacuum pads have a high coefficient friction with the workpiece, the workpiece is consequently rendered immovable.

Figure 15:
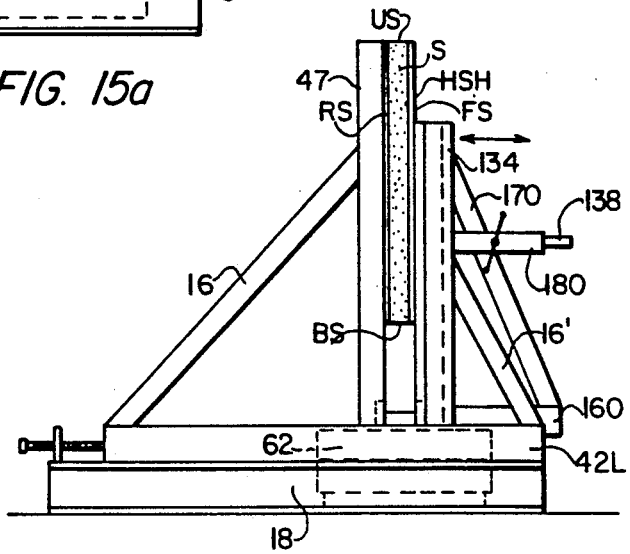

The elevator frame 62 etc. is then lowered by contracting the pneumatic cylinder 130 so that the elevator frame 62 and its associated rollers 52 return to the lower position as shown in FIG. 15. However, the workpiece HSH remains in the elevated position as shown in FIG. 15 and is therefore ready to be cut by the lower flight 38L of the cutter wire which is actuated to move axially at the required velocity deemed optimal for effecting a smooth and efficient cut downwardly through the central portion of the stone slab portion S of the sandwich laminate forming the workpiece. The cutter wire 38 is continuously operated to create a kerf K and is gradually lowered at a desired rate until kerf K extends all the way from upper surface US to the bottom surface BS of the stone slab component of the workpiece to provide two stone-honeycomb laminae panels consisting of a rear panel RP supported by the forwardly facing vacuum pads 44 etc. and a front panel FP supported by the rearwardly facing vacuum pads 48 etc. as shown in FIG. 15(*a*).

Upon completion of the cut, the entire cutter assembly is raised to its upper dashed line position of FIG. 1 with the Lower Flight 38L being above the upper edge of the finished panels as shown in FIG. 16. The elevator frame 62 etc. is then raised to its upper position (the dashed line position of FIG. 16) in which its conveyor rollers 52 engage the lower surface of the panels RP and FP; the vacuum supply to the front and rear vacuum pads is then terminated and the pads ar vented so that the finished panels RP and FP are released by the vacuum pads and supported by elevator conveyor roller 52. The elevator frame 62 etc. is then lowered to its solid line position of FIG. 16 in which its conveyor rollers 52 are in alignment with the conveyor rollers of the outfeed conveyor 260 and the panels RP and FP are then fed from the work station onto the outfeed conveyor from which they are delivered to a packing or shipping area.

The inventive apparatus and method permits the provision of acceptable finished stone-honeycomb panels having a maximum length of eleven feet and width of six feet as compared to the prior acceptable stone-honeycomb panels which had a maximum width of nine and one-half feet and a maximum width of five feet. Moreover, the improved result is achieved by a rapid and smooth cut through the original workpiece without any manipulation of the workpiece being required during the time that the cutting operation is actually being performed; the larger panels are consequently produced in less time than the smaller prior art panels.

While numerous modifications of the invention will undoubtedly occur to those skilled in the art, it should be understood that the spirit and scope of the invention is to be limited solely by the appended claims.

I claim:

1. Apparatus for cutting a workpiece in the form of a slab having a given thickness between substantially parallel opposite sides, a given height between upper and lower surfaces, said apparatus comprising;

(a) a power-driven closed loop wire cutter member having a linear cutter flight;

(b) a first bank of vacuum suction pads oriented in a first plane;

(c) a second bank of vacuum suction pads oriented in a second plane;

(d) movable support means engageable with said lower surface of one of said workpieces in a work position between said first and second banks of vacuum suction pads in which said upper surface of said workpiece faces said cutter flight;

(e) means for permitting said first and second banks of vacuum suction pads to respectively engage said opposite sides of said workpiece in said work position so that said vacuum suction pads are forcefully urged against said opposite sides;

(f) means for disengaging said movable support means from contact with said lower surface of said workpiece so that said workpiece is supported soley by said vacuum suction pads; and (g) means for effecting movement of said cutter flight relative to said workpiece to cause said cutter flight to cut through said workpiece from said upper surface to said lower surface of said workpiece to divide said workpiece into two finished panels.

2. The apparatus of claim 1 wherein said movable means includes a vertically movable elevator.

3. The apparatus of claim 2 wherein said vertically movable elevator moves from a lower position to a higher position when positioning said workpiece in said work position between said first and second banks of suction pads.

4. The apparatus of claim 3 wherein said means for permitting said first and second banks of vacuum pads to engage opposite sides of said workpiece includes carriage means supporting one of said banks of vacuum pads for movement toward the other bank of vacuum pads.

5. The apparatus of claim 4 additionally including infeed conveyor means for feeding a workpiece onto said vertically movable elevator means when said elevator means is in said lower position.

6. The apparatus of claim 5 additionally including an outfeed conveyor for feeding said finished panels from said elevator means when said elevator means is in its lower position.

7. The apparatus of claim 6 additionally including power driven conveyor rollers on said elevated means for aiding conveyor rollers on said elevator means for aiding in the receiving of said workpiece into said work position and the discharge of said finished panels to said outfeed conveyor.

8. The apparatus of claim 1 wherein said first plane and said second plane are on opposite sides of a vertical plane passing through said linear cutter flight; said linear cutter flight also being positioned in a horizontal plane.

* * * * *